United States Patent [19]

Akita et al.

[11] Patent Number: 4,498,324

[45] Date of Patent: Feb. 12, 1985

[54] RESTRAINED MANDREL MILL INLET TABLE

[75] Inventors: Shinji Akita; Megumu Tanaka, both of Yokohama, Japan

[73] Assignee: Nippon Kokan Kabushiki Kaisha, Tokyo, Japan

[21] Appl. No.: 477,326

[22] Filed: Mar. 21, 1983

[30] Foreign Application Priority Data

Mar. 25, 1982 [JP] Japan ..... 57-46342

[51] Int. Cl.[3] ..... B21B 17/10

[52] U.S. Cl. ..... 72/208; 72/251

[58] Field of Search ..... 72/208, 209, 251; 198/575, 576, 782

[56] References Cited

U.S. PATENT DOCUMENTS

| | | | |
|---|---|---|---|
| 671,991 | 4/1901 | Diescher | 72/251 |
| 1,728,538 | 9/1929 | Gentil et al. | 198/782 |
| 1,964,507 | 6/1934 | Diescher | 72/251 |
| 3,392,565 | 7/1968 | Rodder | 72/201 |
| 3,593,553 | 7/1971 | Rodder | 72/209 |
| 4,233,834 | 11/1980 | Matinlassi | 72/208 |

FOREIGN PATENT DOCUMENTS

| | | | |
|---|---|---|---|
| 2122877 | 11/1972 | Fed. Rep. of Germany | 72/421 |
| 103716 | 6/1982 | Japan | 72/209 |

OTHER PUBLICATIONS

Schuetz et al., "Current Trends in Seamless Tube Mill Design," *Iron & Steel Engineer,* Sep. 1976, pp. 47–57.

*Primary Examiner*—E. Michael Combs
*Assistant Examiner*—Charles Rosenberg
*Attorney, Agent, or Firm*—Fleit, Jacobson, Cohn & Price

[57] ABSTRACT

An inlet table for a restrained mandrel mill includes a plurality of roll units arranged in the pass line direction and the roll units are mechanically swung in synchronism with the forward and backward movements of a mandrel bar, thereby supporting the mandrel bar and/or a shell to be rolled on the pass line and preventing the roll units from striking against a restrained bar for moving the mandrel bar.

7 Claims, 14 Drawing Figures

RESTRAINED MANDREL MILL INLET TABLE

The present invention relates to a restrained mandrel mill for seamless tubes and more particularly to a roll lifting apparatus for a restrained mandrel mill inlet table.

The restrained mandrel mill is such that a mandrel bar is inserted through a hollow shell (hereinafter referred to as a shell) obtained by piercing the billet by a piercing mill or a shell elongated by any other elongating mill and the shell is passed into a continuous rolling mill including usually six to nine consecutive stands of two-rolls or three-rolls thereby continuously rolling the shell between the mandrel bar and the rolling rolls to the desired tube size. During the rolling of the shell, the axial (lengthwise) movement of the mandrel bar is controlled (restrained).

There are many different methods of using the mandrel bar such that after completion of the rolling, while the shell is passed to the next operation, the mandrel bar is pulled back to the rolling preparation position where it is cooled, coated with a lubricating oil and then inserted again into the next shell, the mandrel bar is pulled back to the initial position before the start of the rolling where it is uncoupled with the restrained bar and then it is side shifted from the pass line, or at the rolling ending position the mandrel bar is uncoupled with the restrained bar, moved forward in this condition, side shifted from the pass line after passing through the mill, cooled, coated with a lubricant and then used repeatedly.

With this type of mandrel mill, an inlet table of as long as several tens meters is arranged at the entry side of the mill and rolls are arranged on the inlet table so as to support the shell and the mandrel bar which are moved at a high speed along the pass line.

FIGS. 1 and 2 are schematic side views showing a prior art inlet table by way of example. In the Figures, numeral 1 designates a mandrel bar, and 2 a shell into which the mandrel bar is inserted. Numeral 31 designates a restrained bar coupled to the mandrel bar 1 to pass the shell 2 and the mandrel bar 1 between rolling rolls 41, 41*a* and 42, 42*a* of a rolling mill 4 and control (restrain) the movement of the mandrel bar 1 during the rolling of the shell 2, having at the top thereof a coupler adapted for engagement with the bottom of the mandrel bar 1 and driven forward and backward, respectively, at a high speed along the pass line by means of chains or motor driven gears which are arranged on both sides of the bar and not shown. Designated at T is an inlet table having arranged thereon a plurality (7 in the Figures) of roll units 5 each including a roll 53 rotatably mounted on two arms 52 rotatably mounted on a shaft 51, and also pinch rolls 54 are located at the inlet end of the rolling mill 4. (Hereinafter the roll units may possibly be designated by reference numerals ① to ⑦). Numeral 55 designates a hydraulic cylinder whose operating rod 56 is connected to the arms 52 (while, in the Figures, only the single hydraulic cylinder 55 is shown by way of a typical example, a similar hydraulic cylinder is connected to the arms 52 of each roll unit). Most of the rolls 53 are driven in the forward and reverse directions to move the mandrel bar 1 and the shell 2 and some of the rolls 53 serve as idler rolls.

Then, just before the time that the mandrel bar 1 and the shell 2 are moved forward in the direction of an arrow a by the restrained bar 31 and the shell 2 is moved into the rolling mill 4, the rolls 53 of the roll units ① to ⑦ are supporting the mandrel bar 1 and the shell 2 as shown in FIG. 1.

In this case, the thickness $t_3$ of the restrained bar 31 below the pass line P—P (the half of the whole thickness) is greater than the thicknesses (radii) $t_1$ to $t_2$ of the mandrel bar 1 and the shell 2 below the pass line P—P. Thus, if, in this condition, the restrained bar 31 is advanced in the arrow a direction, there is the danger of the top of the restrained bar 31 striking against the rolls 53 of the roll units 5 thus damaging the restrained bar 31 and the shell 2, bending the mandrel bar 1 or causing any other serious fault.

As a result, the top position of the restrained bar 31 is detected and a signal is sent to each of the hydraulic cylinders 55, thus operating the hydraulic cylinder 55 of each roll unit just before the restrained bar 31 reaches the roll thereof and rotating the arms 52 about the shaft 51 in a counterclockwise direction, thereby causing the roll 53 to clear and avoid a collision with the restrained bar 31. Similarly, when the mandrel bar 1 is moved backward in the direction of an arrow b, the position of the backwardly moving restrained bar 31 is detected and a signal is sent to the hydraulic cylinder 55 of each roll unit just after the restrained bar 31 passes through the roll thereof, thereby rotating the arms 52 in a clockwise direction and causing the roll 53 to support the mandrel bar 1, thus supporting the mandrel bar 1 on the pass line P—P to allow its smooth backward movement and prevent the occurrence of bending and the like.

However, the known roll unit of the above-described construction has the danger of causing any fault in the sensors, delay in the operation of the hydraulic cylinders and the like and are not reliable, and therefore there has existed a need for the development of roll units which are reliable and stable in operation.

The present invention has been made to meet these requirements and it is an object of this invention to provide a novel arrangement of roll units in which each roll supporting arm is adapted to swing about its rotary shaft and the swinging motion of the arms is mechanically associated in synchronism with the forward and backward movements of a restrained bar for moving a mandrel bar, thereby reversibly swinging the roll units so as to avoid a collision between the rolls and the restrained bar and also positively supporting the shell and the mandrel bar on the pass line by a suitable number of the rolls.

It is another object of the invention to provide such novel arrangement of roll units in which in order to prevent the danger of a situation arising where when the rolling of the shell is completed so that the mandrel bar is pulled out of the shell the mandrel bar top is lowered from the pass line by an amount corresponding to the shell wall thickness thus frequently tending to bend the mandrel bar, at the same time that the mandrel bar is pulled out of the shell the roll units located near the rolling mill entry are raised quickly so as to support the mandrel bar on the pass line.

It is still another object of the invention to provide such novel arrangement of roll units in which a part or all of the rolls of the plurality of roll units are forcibly and accurately driven into swinging so as to facilitate the forward and backward movements of the mandrel bar and the forward movement of the shell.

It is still another object of the invention to provide a novel inlet table for roll units in which when the shell size and/or the mandrel bar diameter are changed, the vertical positions of the rolls are adjusted to the proper heights so as to align the center of the mandrel bar and the shell with the pass line and thereby effect the rolling.

The above and other objects, features and advantages of the invention will become apparent from the following description taken in conjunction with the accompanying drawings.

Figure 1:
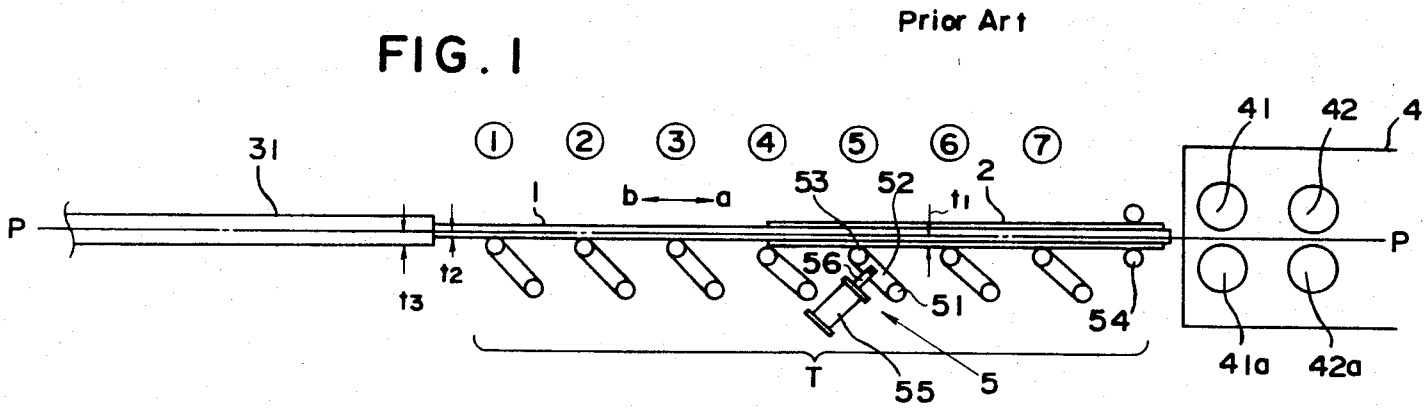
FIG. 1 is a side view showing schematically the basic construction of a prior art inlet table and the condition in which a shell having a mandrel bar inserted thereinto is just before its entry into a rolling mill.
Figure 2:
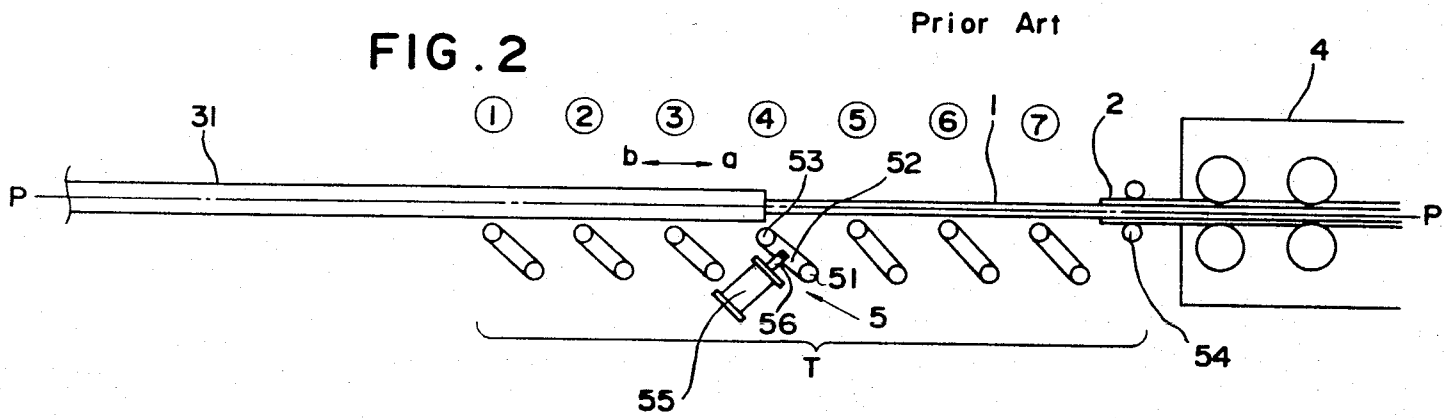
FIG. 2 is a side view for explaining the operation of the roll units in the condition where the shell is being rolled in an advanced position with respect to its position in FIG. 1.
Figure 3:
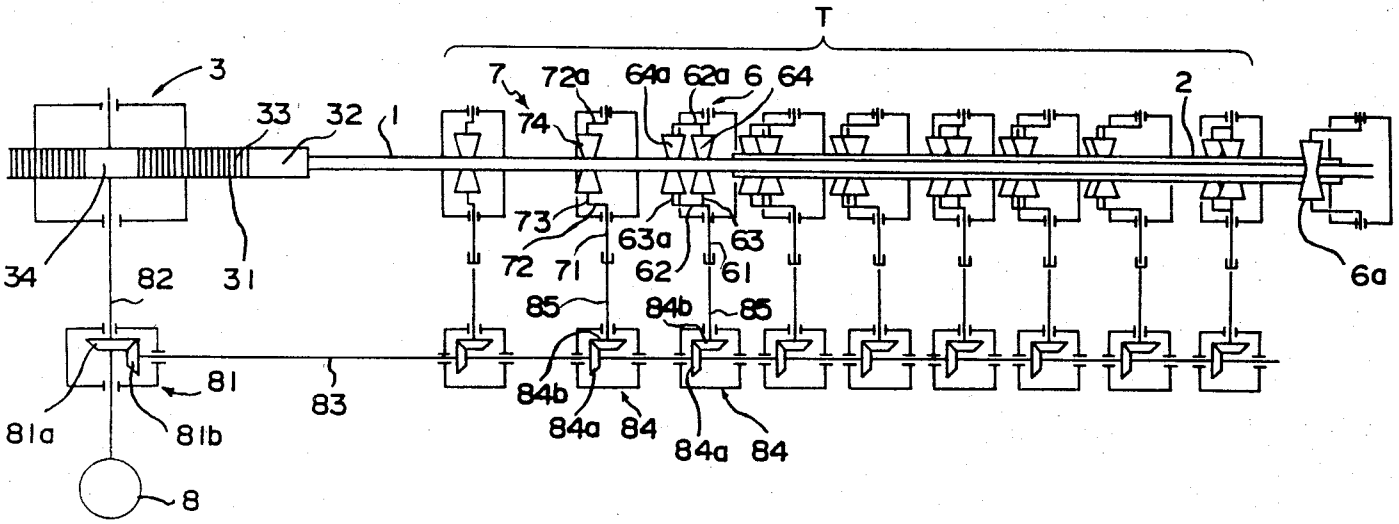
FIG. 3 is a plan view showing schematically the basic construction of an embodiment of the invention.
Figure 4:
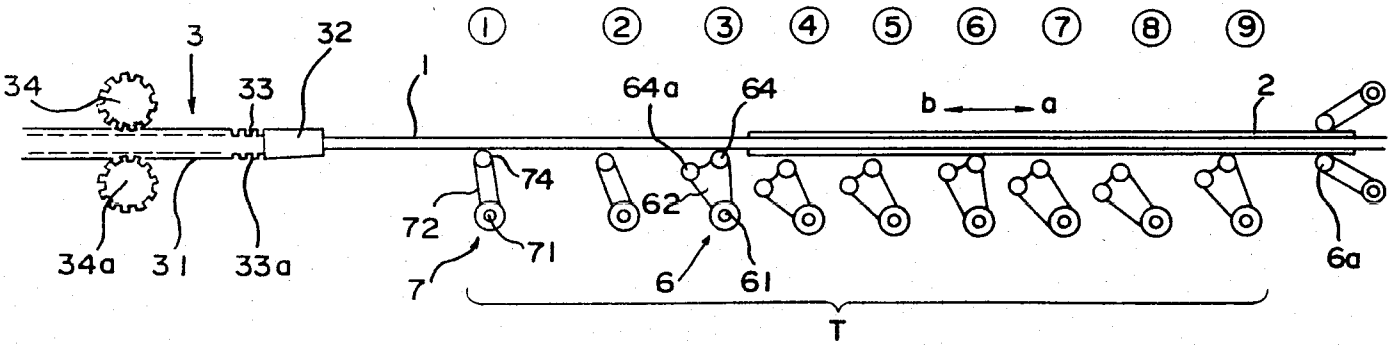
FIG. 4 is a side view of FIG. 3 with a part thereof being eliminated.

The present invention will now be described in greater detail with reference to FIGS. 3 and 4, in which numeral 1 designates a mandrel bar, 2 a shell, and 3 a restrainer for the mandrel bar 1 which includes a restrained bar 31 having a coupler 32 for the mandrel bar 1 and racks 33 and 33*a* and pinions 34 and 34*a* adapted to engage with the racks 33 and 33*a*, respectively and move the restrained bar 31 in the forward or backward direction. Designated at T is an inlet table on which are arranged a plurality of roll units 6 and 7 (a total of nine units in the Figure), and most of the roll units, i.e., the roll units 6 located remote from the restrained bar 31, each comprises a pair of parallel rolls. Namely, each roll unit 6 includes a rotary shaft 61, a pair of arms 62 and 62*a* fixedly mounted on the shaft 61 and a pair of rolls 64 and 64*a* respectively mounted fixedly on shafts 63 and 63*a* rotatably supported between the arms 62 and 62*a*. Each of the roll units 7, which are smaller in number and located nearer to the restrained bar 31, includes a single roll, that is, it comprises a rotary shaft 71, a pair of arms 72 and 72*a* fixedly mounted on the shaft 71 and a roll 74 fixedly mounted on a shaft 73 rotatably mounted between the arms 72 and 72*a*. A gear unit 81 comprising bevel gears 81*a* and 81*b* is arranged between the pinions 34 and 34*a* for driving the restrained bar 31 and a drive motor 8 and a transmission shaft 83 is extended from the gear unit 81 in parallel with the mandrel bar 1. A gear drive 84 including bevel gears 84*a* and 84*b* is arranged on the intermediary portion of the transmission shaft 83 for each of the roll units 6 and 7 and an output shaft 85 of each gear drive 84 is connected to the rotary shaft 61 or 71 of the roll unit 6 or 7. As a result, the arms 62, 62*a*, 72 and 72*a* of the roll units 6 and 7 are reversibly swung in synchronism with the forward and backward movements of the restrained bar 31 (hereinafter the roll units 6 and 7 may sometimes be referred to as ① to ⑨. The Figures show the case where the minority roll units ① and ② each has a single roll mounted therein and each of the roll units ③ to ⑨ has two rolls mounted therein. Numeral 6*a* designates pinch rolls.

Figure 5:
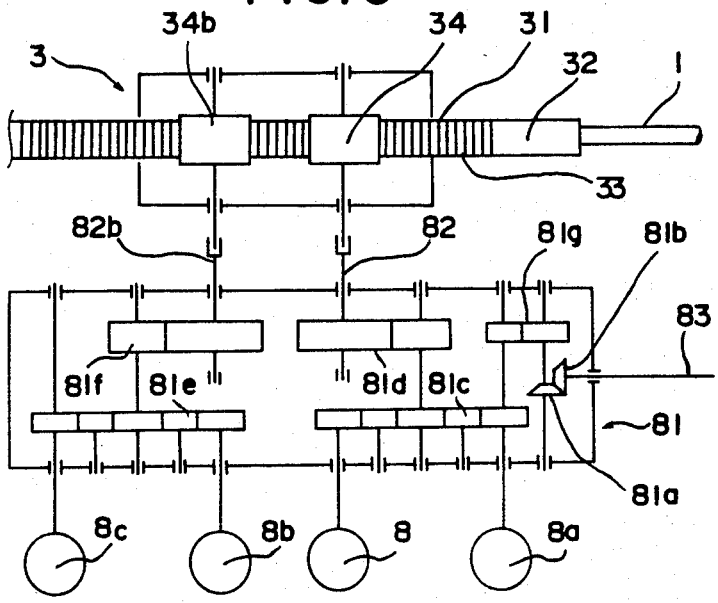
FIG. 5 is a plan view showing schematically an embodiment of a restrained bar drive system.

Referring to FIG. 5, there is illustrated an exemplary basic construction of the drive system for the restrained bar 31. Note that the illustrated drive system includes eight drive motors arranged in the form of four consecutive two-high motors (the lower motors are not shown). Since the roll units ① and ② are closer to the restrained bar 31, they must be swung earlier than the other to prevent them from colliding with the restrained bar 31 and moreover the mandrel bar 1 is deflected to a lesser extent thus making it necessary for them to include only one roll. On the contrary, each of the roll units ③ to ⑨ are located remote from the restrained bar 1 than the former and the mandrel bar 1 is deflected to a greater extent, thus making it necessary to increase the contact time between the roll units and the mandrel bar 1 or the shell 2 and mounted two rolls in each of them. The outputs of motors 8 and 8*a* are transmitted to the pinion 34 by a drive shaft 82 through gear trains 81*c* and 81*d* of the gear unit 81 and the outputs of motors 8*b* and 8*c* are transmitted to the pinion 34*b* by a drive shaft 82*b* through gear trains 81*e* and 81*f* thereby synchronously driving the restrained bar 31. Also, the output of the motor 8*a* is transmitted to the gear drive 84 of each of the roll units 6 and 7 through a gear train 81*g* and the output shaft 83 of the bevel gears 81*a* and 81*b*. Note that the shaft 83 may be replaced with a chain, belt or the like to effect the transmission of power.

Figure 6:
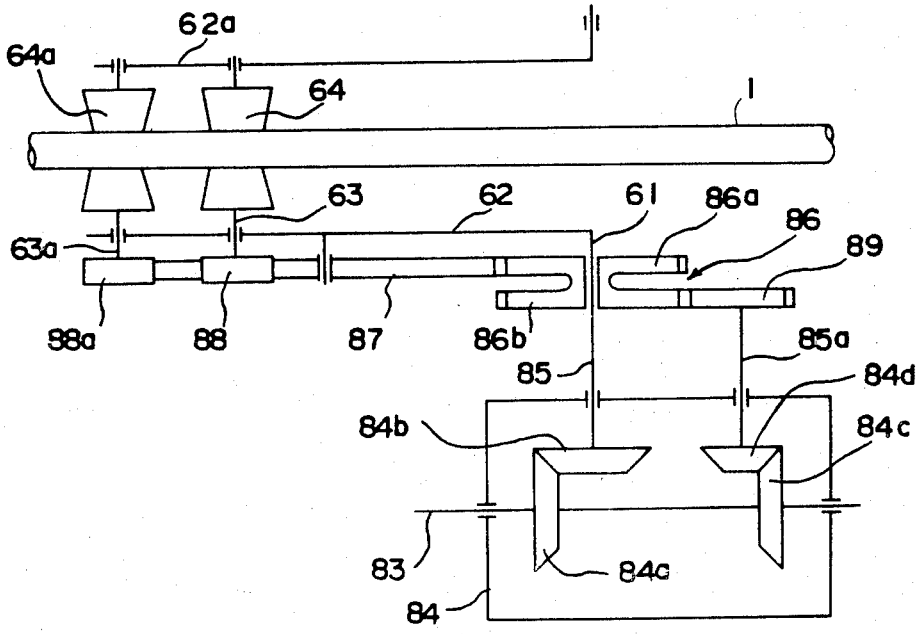
FIG. 6 is a plan view showing schematically an embodiment of a roll gear drive.

Referring to FIG. 6 showing an exemplary basic construction of a drive unit for the rolls 64 and 64*a* (while the drive unit for the two-roll units is shown, the same construction is used for the single-roll units), a double gear 86 is loosely mounted on an output shaft 85 of the one bevel gear 84*b* in the gear drive 84 and one gear 86*a* of the double gear 86 is meshed with an intermediate gear 87 which is loosely mounted on the shaft attached to the arm 62. The intermediate gear 87 is meshed with gears 88 and 88*a* which are respectively mounted on the shafts 63 and 63*a* of the rolls 64 and 64*a*, and the rotation of the other bevel gears 84*c* and 84*d* mounted fixedly on the shaft 83 is transmitted to the other gear 86*b* of the double gear 86 through a shaft 85*a* and a gear 89. As a result, the arms 62 and 62*a* are swung about the shaft 61 in synchronism with the pinions 34 and 34*a*, etc., and also the rolls 64 and 64*a* are swung in the forward and backward directions in synchronism with the pinions 34 and 34*b*.

Figure 7:
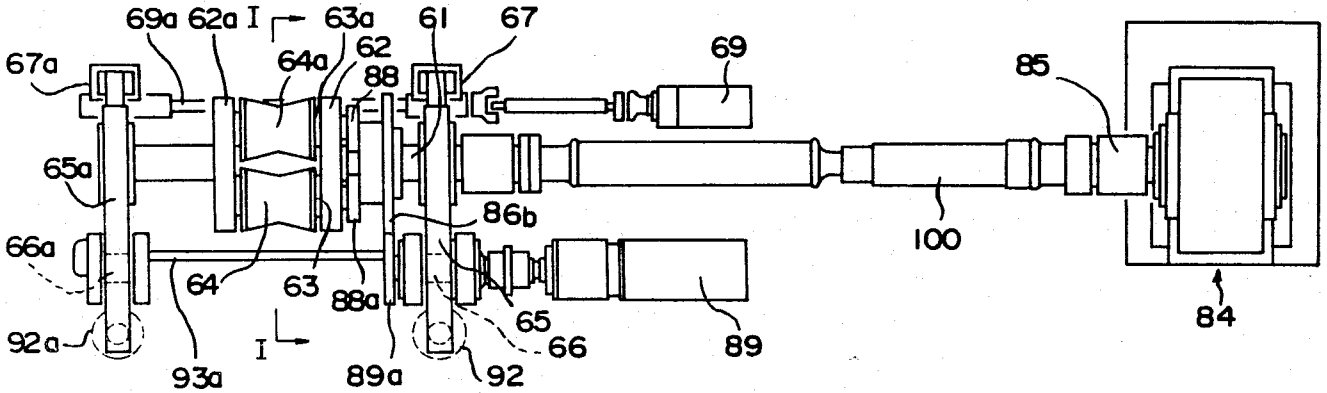
FIG. 7 is a plan view showing an embodiment of roll units.
Figure 8:
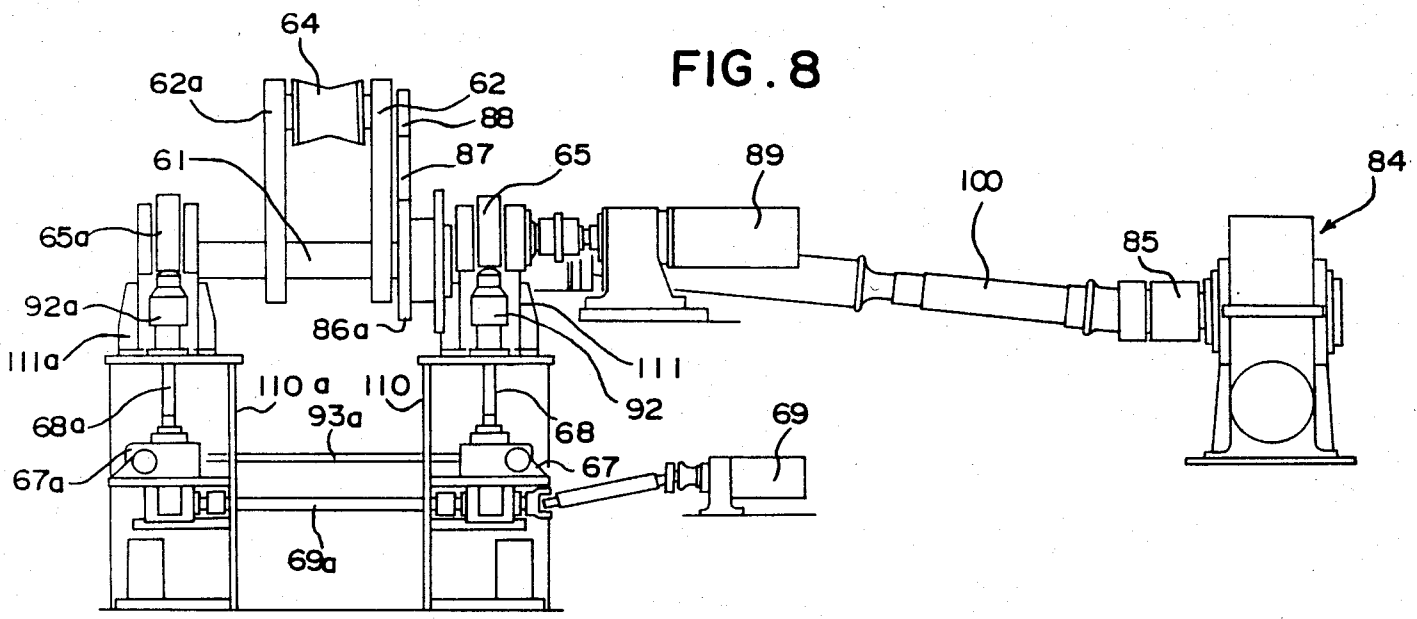
FIG. 8 is a side view of FIG. 7.
Figure 9:
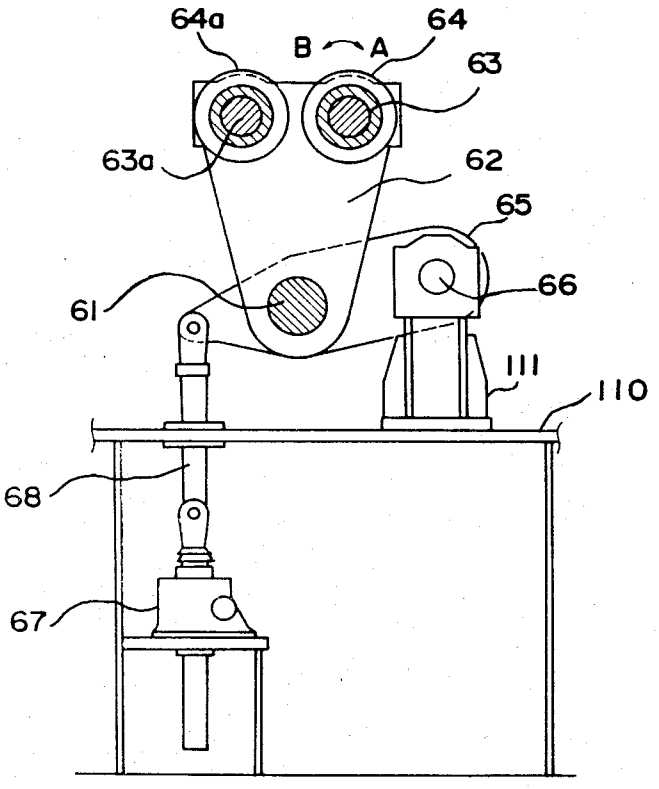
FIG. 9 is a longitudinal sectional view taken along the line I—I of FIG. 7.

Referring to FIGS. 7, 8 and 9, there is illustrated an example of the roll units 6 in which the rotary shaft 61 is coupled by a universal joint 100 to the output shaft 85 of the gear drive 84, and which is swingable in synchronism with the pinion 34 for driving the restrained bar 31, and the roll units ① to ⑨ are swung at different reduction ratios (although some of the units use the same reduction ratio) in a direction A when the restrained bar 31 is advanced in a direction a and in a direction B when the restrained bar 31 is retreated in a direction b (see FIG. 9).

Numerals 62 and 62*a* designate arms fixedly mounted on the rotary shaft 61, 64 and 64*a* rolls fixedly mounted on shafts 63 and 63*a* which are rotatably mounted in the arms 62 and 62*a* through bearings. Numerals 65 and 65*a* designate rocker arms which are loosely mounted on the rotary shaft 61 on the outer side of the arms 62 and 62*a*, respectively, and they have their one end pivotably mounted on fixed supporting points 66 and 66*a*, respectively, and their other end respectively coupled to the forward end of connecting rods 68 and 68*a* of screw jacks 67 and 67*a*, respectively. Numeral 69*a* designates a shaft for transmitting the driving force of a motor 69 to the other screw jack 67*a*. Numerals 110 and 110*a* designate bases for supporting the rocker arms 65 and 65*a*, respectively, and attached to mounts 111 and 111*a* arranged on the bases 110 and 110*a* are the shafts forming the fixed supporting points 66 and 66*a* of the rocker arms 65 and 65*a*. As a result, if the diameter of the mandrel bar 1 and/or the size of the shell 2 are changed, the motor 69 (FIG. 7) is operated so that the screw jacks 67 and 67*a* are raised or lowered and the positions of the rolls 64 and 64*a* are adjusted to any given heights.

Figure 10:
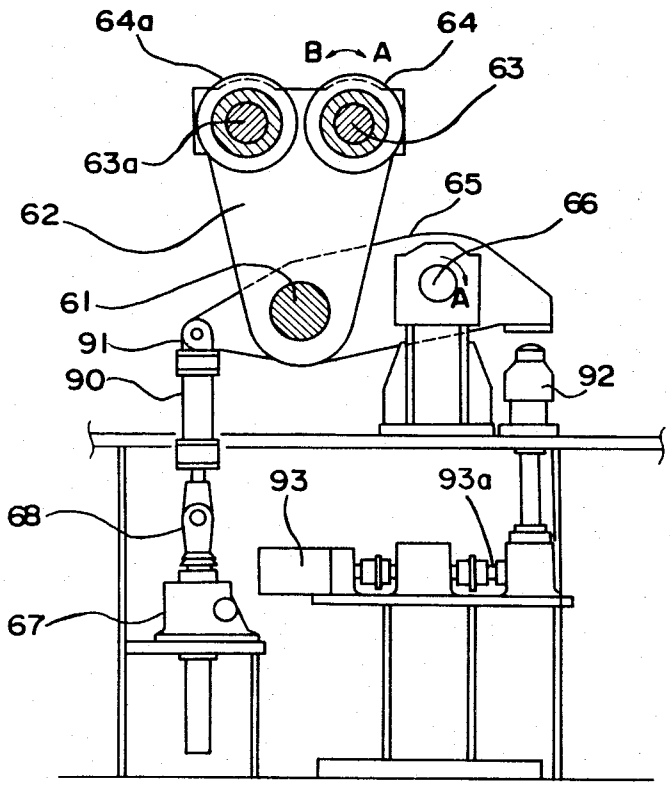
FIG. 10 is a longitudinal sectional view showing another embodiment of the roll units in correspondence to FIG. 9.

Referring to FIG. 10, there is illustrated a longitudinal sectional view similar to FIG. 9 showing another embodiment of the roll unit 6. As shown in the Figure, quick lifting mechanisms (hereinafter referred to as a quick mechanisms) are added to the rolls 64 and 64*a* and the remaining construction is substantially the same with the construction of FIG. 9. The construction of this quick mechanism will now be described with respect to the one arranged on one side. The quick mechanism of the rolls 64 and 64*a* includes a hydraulic cylinder 90 connected to the forward end of the connecting rod 68 of the screw jack 67 and its operating rod 91 is connected to one end of the rocker arm 65 whose other end is extended from the supporting point 66 so as to face a limit means 92 positioned below the free end of the rocker arm 65. Numeral 93*a* designates a shaft for transmitting the driving force of a motor 93 to the other limit means 92*a*.

As mentioned previously, when the mandrel bar 1 is pulled out of the shell 2, its top is lowered from the pass line by an amount equal to the wall thickness of the shell 2 thus involving the danger of causing a bend in the mandrel bar 1. In accordance with the invention, at the same time that the mandrel bar 1 is pulled out of the shell 2 the hydraulic cylinder 90 is operated so that the operating rod 91 is raised and the rocker arm 65 is swung about the supporting point 66 in the direction A, thereby quickly raising the rolls 64 and 64*a* and holding the mandrel bar 1 on the pass line. The limit means 92 limits the range of rotation of the rocker arm 65 so as to limit its height and thereby place the rolls 64 and 64*a* in given raised positions. In this case, the adjustment of the raised positions of the rolls 64 and 64*a* can be effected without the provision of the limit means 92 if the operating rod 91 is adapted to come into the desired raised position through the adjustment of the oil quantity in the hydraulic cylinder 90. The quick mechanisms of this type are incorporated in some of the roll units.

Figure 12:
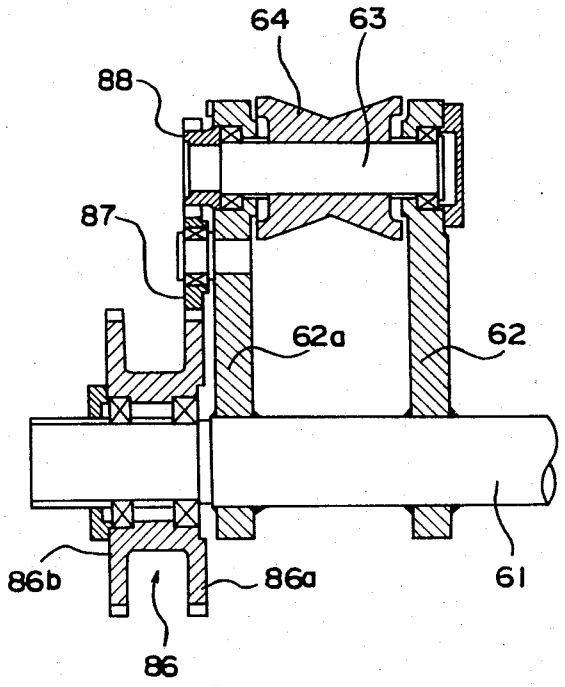
FIG. 12 is a longitudinal sectional view taken along the line II—II of FIG. 11.
Figure 11:
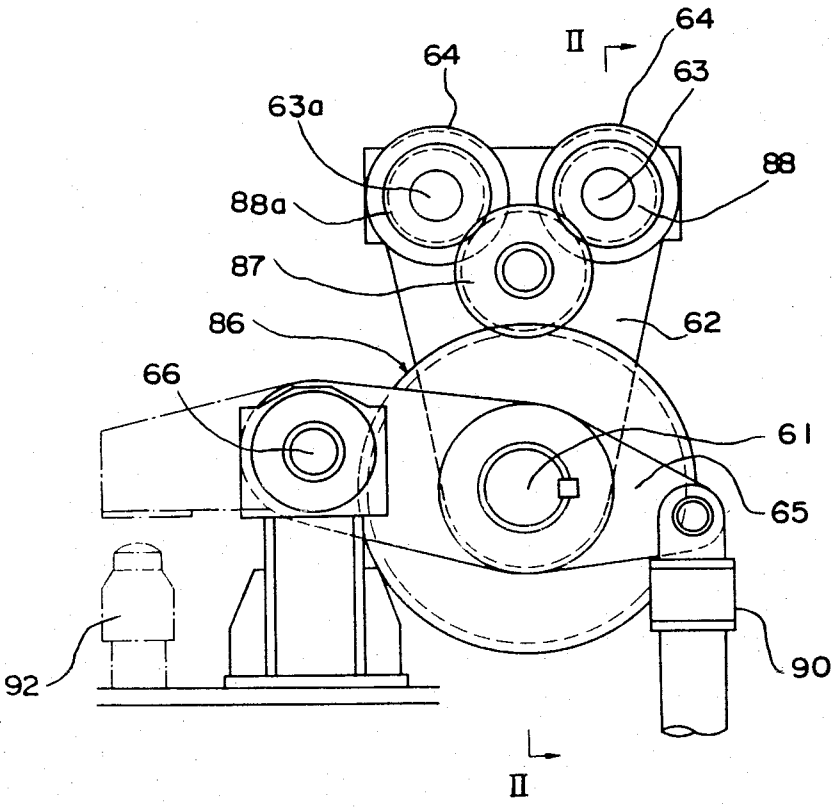
FIG. 11 is a front view showing another embodiment of the roll gear drive.

FIGS. 11 and 12 show still another embodiment of the gear drive of the rolls 64 and 64*a*, in which the one gear 86*a* of the double gear 86 mounted on the rotary shaft 61 through a bearing is connected to the gears 88 and 88*a* fixedly mounted on the shafts 63 and 63*a* of the rolls 64 and 64*a* through the intermediate gear 87 and the other gear 86*b* of the double gear 86 is meshed with a gear 89*a* of the motor 89 (see FIGS. 6 and 7) for driving the rolls 64 and 64*a*. In this way, the rolls 64 and 64*b* can be swung independently of the pinions 34 and 34*a*. The roll gear drives of this type are incorporated in some or all of the roll units.

Figure 13:
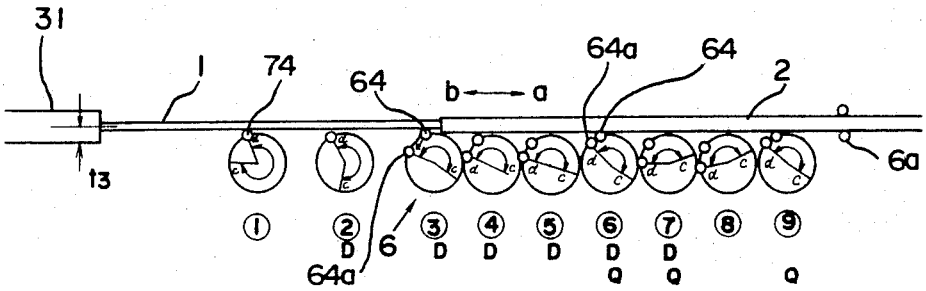
FIG. 13 is a schematic diagram for explaining the relationship between the path of the restrained bar top and the contacting time of the rolls with the mandrel bar of the shell.
Figure 14:
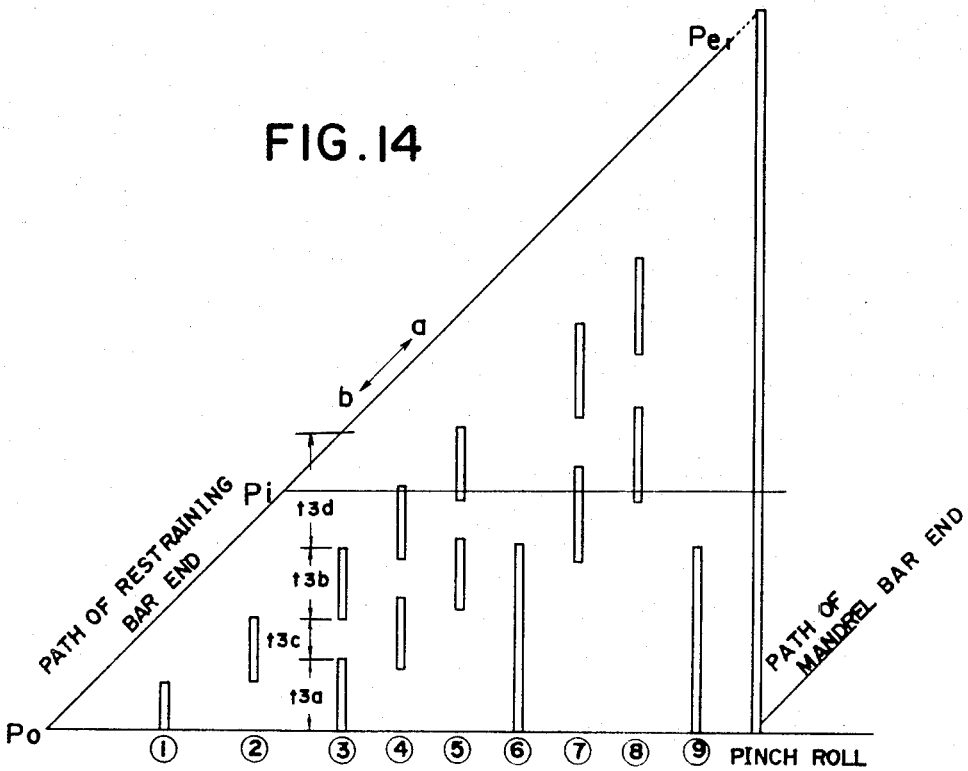

Referring now to FIG. 13, the operation of this embodiment will now be described. The various data of the roll units ① to ⑨ in this embodiment are shown in the following Table 1. FIG. 13 is a schematic operation explanatory diagram showing the relationship between the mandrel bar 1 and the shell 2 and the roll units ① to ⑨ in the like manner as FIG. 4, and FIG. 14 is a graph showing the relationship between the path of the restrained bar top and the contact time between the roll units ① to ⑨ and the mandrel bar 1 or the shell 2 with the ordinate representing the time and the absissa representing the distance of travel of the mandrel bar 1. FIGS. 13 and 14 are shown in correspondence to each other. Note that symbol D designates the roll unit having the gear drive for the rolls 64 or 74 and Q designates the roll unit having the quick mechanisms. Also, in FIG. 14 the length of each bar at the position of each roll unit indicates the length of time that each roll is in contact with the mandrel bar 1 or the shell 2. In the case of the roll unit ③, for example, $t_{3a}$ indicates the time that the roll 64 of this roll unit is in contact with the mandrel bar 1 and $t_{3b}$ indicates the time that the other roll 64*a* is in contact with the mandrel bar. Also, $t_{3c}$ indicates the non-contact time due to the gap between the rolls 64 and 64*a* and $t_{3d}$ indicates the time required for preventing a collision with the restrained bar 31. Substantially the same relationship as described so far is applicable to the other roll units. Thus, as will be seen from FIG. 14, at any position of the restrained bar 31 the mandrel bar 1 and/or the shell 2 are supported by at least one of the roll units and in this way a continuous supporting structure is provided. Designated by $P_e$ is the advanced end position of the restrained bar top.

TABLE 1

| Roll Unit No. | ① | ② | ③ | ④ | ⑤ | ⑥ | ⑦ | ⑧ | ⑨ |
|---|---|---|---|---|---|---|---|---|---|
| Rotary angle/bar stroke (1 m) | 12.502 °/m | 9.259 °/m | 8°/m | ← | ← | 6.5°/m | ← | ← | ← |
| Roll angle when restrained bar is advanced to above roll center | 40° | ← | ← | ← | ← | 74° | 40° | ← | 113° |
| Roll angle for clearing restrained bar thickness (150 mm) | 52.23° | ← | ← | ← | ← | ← | ← | ← | ← |
| Bar stroke/roll position | 0.98 m | 1.32 m | 1.53 m | ← | ← | | 1.88 m | ← | |
| Guide roll holding angle | 20° | ← | ← | ← | ← | 20° × 2 | 20° | ← | 20° × 2 |
| Guide roll holding length | 1.6 m | 2.16 m | 2.5 m | ← | ← | 3.1 m × 2 | 3.1 m | ← | 3.1 m × 2 |
| Reduction gear ratio | 1/31.1 | 1/42.0 | 1/48.6 | ← | ← | 1/59.815 | ← | ← | ← |
| Roll gear drive | | present | present | present | present | present | present | | |

TABLE 1-continued

| Roll Unit No. | ① | ② | ③ | ④ | ⑤ | ⑥ | ⑦ | ⑧ | ⑨ |
|---|---|---|---|---|---|---|---|---|---|
| Qucik mechanism | | | | | | " | " | | present |

(Note)
← indicates the same value as the preceding one.

Referring first to the condition of FIG. 13 where the restrained bar 31 starts advancing in the direction a, as shown at a point $P_o$ in FIG. 14, the mandrel bar 1 is supported by the rolls 74 and 64 of the roll units ① and ③ and the shell 2 is supported by the rolls 64 of the roll units ⑥ and ⑨ and the pinch rolls 6*a*. Of these roll units, the rolls 64 of the roll units ③ and ⑥ are rotated about their own axes by the gear drives (the pinch rolls 6*a* always support the shell 2 and therefore their explanation will be omitted in the description to follow). Then, when the restrained bar 31 is advanced at a high speed in the arrow a direction as shown in FIG. 14, the rotary shafts 61 and 71 of the roll units ① to ⑨ which are connected to the driving source with the reduction ratios shown in Table 1 are respectively rotated in a clockwise direction as the restrained bar 31 is moved forward. For instance, at a point $P_i$, the rolls 74 and 64 of the roll units ①, ② and ③ are swung greatly in the clockwise direction to avoid a collision with the restrained bar 31 and the roll units ④ and ⑤ are swung so as to support the mandrel bar 1. Also the roll units ⑦ and ⑧ are swung so as to support the shell 2.

In this way, each of the rolls 74 and 64 of the roll units ① to ⑨ is swung clockwise (in the direction c) within the range of arrows c and d and the mandrel bar 1 and the shell 2 are thus supported by one to six of the rolls at all times thereby introducing the shell 2 into the rolling mill. Since each of the rolls will be swung to a position lower than the pass line P—P by an amount equal to or greater than a thickness $t_3$ by the time that the restrained bar 31 reaches above each roll, there is no danger of the restrained bar 31 striking against the rolls. In the condition just before the completion of the rolling of the shell 2, each of the rolls 64 is at the position c in FIG. 13.

When the rolling of the shell 2 is over so that the mandrel bar 1 is moved backward in the direction of the arrow b, the rolls 74 and 64 of the roll units ① to ⑨ are swung in a counterclockwise direction (the direction d). When the restrained bar 31 and the mandrel bar 1 are each moved back to a given position so that the mandrel bar 1 is pulled out of the shell 2, the top of the mandrel bar 1 is lowered by the wall thickness of the shell 2 and displaced from the pass line P—P correspondingly thus giving rise to the danger of bending the mandrel bar 1 or making the backward movement of the mandrel bar 1 not smooth. For this reason, in accordance with the invention, as soon as the mandrel bar 1 is removed from the shell 2, the rolls 64 of the roll units ⑥, ⑦ and ⑨ located near the mill entry end are raised quickly by the quick mechanisms and the mandrel bar 1 is supported along the pass line P—P.

When the mandrel bar 1 is moved backward at a high speed in the direction of the arrow b, the rolls 74 and 64 of the roll units ① to ⑨ are swung in the counterclockwise direction and the mandrel bar 1 is always supported by several of the rolls. After completion of the backward movement of the mandrel bar 1, the roll units 6 previously raised quickly by the quick mechanisms are lowered by the time that the next shell 2 is entered.

While, in the above-description, the various data of the roll units are shown in Table 1, the present invention is not intended to be limited thereto and these data may of course be changed in accordance with the shell rolling speed and various other conditions. Further, the driving means of the mandrel bar driving restrained bar include the racks, it is possible to use any other restraining and feeding means such as a chain drive or cylinder unit. Still further, while the exemplary constructions of the gear system, the roll units, the quick mechanisms and the roll gear drives are shown, various other means may be used provided that the same objects and functions are attained.

From the foregoing description it will be seen that in accordance with the invention, by virtue of the fact the rotary shafts each having the roll or rolls mounted thereon through the arms are connected to the driving source of the mandrel bar restrainer through the reduction gears and the shafts are swung reversibly in synchronism with the forward and backward movements of the mandrel bar thereby preventing the restrainer and the rolls striking against each other and supporting the shell and the mandrel bar by a suitable number of the rolls, there is realized a restrained mandrel mill including an inlet table which is positive in operation and having no danger of any collision between the mandrel bar and the rolls. Thus, in accordance with the invention there is no danger of causing any damage to the restrainer and the rolls and the operating efficiency is improved.

What is claimed is:

1. An inlet table for a restrained mandrel mill comprising:

a plurality of roll means arranged in the direction of a pass line to support a mandrel bar /or a shell to be rolled; and a restrained bar coupled to said mandrel bar and mounted for reciprocal movement relative to said roll means;

means for reciprocating said restrained bar; gear means interconnecting said restrained bar and said roll means for mechanically transmitting the movement of said restrained bar to said roll means; and wherein each of said roll means includes at least one roll mounted on an arm supported so that the arm can be swung reversibly about a rotary shaft in response to a forward movement or a backward movement of said restrained bar, whereby at least one of said plurality of roll means supports said mandrel bar and/or the shell to be rolled on the pass line.

2. An inlet table according to claim 1, wherein at least one of said roll means includes quick means for quickly displacing the at least one roll thereof vertically.

3. An inlet table according to claim 1, wherein the majority of said plurality of roll means is positioned remote from said restrained bar and each includes two rolls, and wherein the minority of said roll means each includes a single roll.

4. An inlet table according to claim 1, wherein each of said roll means comprises a rotary shaft secured to one end of each of a pair of arms, at least one roll mounted on the other end of each of said arms, and transmission means connected to said rotary shaft to transmit power thereto from drive means of said restrained bar, and wherein at least one of said roll means effects the transmission of power between said roll and said transmission means through a double gear loosely mounted on said rotary shaft and drivingly connected to said restrained bar drive means through a plurality of gears.

5. An inlet table according to claim 4, wherein the rotary shaft of each said roll means is loosely mounted between a pair of rocker arms each having one end forming a fixed .supporting point and the other end forming a movable supporting point.

6. An inlet table according to claim 5, wherein quick lift means adapted for quick vertical movement and slow lift means adapted for slow vertical movement are consecutively connected to the movable supporting point of each of said rocker arms.

7. An inlet table according to claim 6, wherein each said rocker arm includes a free end that extends beyond said fixed supporting point, and wherein adjustable limit means is positioned adjacent said free end and engageable therewith to control the movement thereof.

* * * * *